US005450614A

United States Patent [19]

Rodriguez

[11] Patent Number: 5,450,614

[45] Date of Patent: Sep. 12, 1995

[54] ARROW TRACKING APPARATUS

[76] Inventor: Richard A. Rodriguez, 20 Barbara St., Bloomfield, N.J. 07003

[21] Appl. No.: 61,300

[22] Filed: May 14, 1993

[51] Int. Cl.[6] ..... H04B 7/00; A63B 65/02

[52] U.S. Cl. ..... 455/66; 455/98; 455/128; 273/416

[58] Field of Search ..... 455/66, 98, 95, 96, 455/128, 344, 347, 348, 251, 70; 340/539, 573; 273/416, 420, 423; D22/101, 107, 115, 116; 124/88; 343/718, 720

[56] References Cited

U.S. PATENT DOCUMENTS

| | | | |
|---|---|---|---|
| 3,840,944 | 10/1974 | Gresley | 124/88 |
| 4,940,245 | 7/1990 | Bittle, Jr. | 455/98 |
| 4,976,442 | 12/1990 | Treadway | 273/416 |
| 5,024,447 | 6/1991 | Jude | 273/416 |
| 5,167,417 | 12/1992 | Stacey et al. | 273/416 |
| 5,188,373 | 2/1993 | Ferguson et al. | 273/416 |
| 5,274,927 | 1/1994 | Arnt | 124/88 |

*Primary Examiner*—Reinhard J. Eisenzopf
*Assistant Examiner*—Lisa Charouel

[57] ABSTRACT

A new and improved arrow tracking apparatus includes a radio transmitter assembly, attached to an arrow, for transmitting radio waves associated with the arrow. The radio transmitter assembly is in the form of a jacket that jackets a shaft of the arrow. A battery-powered hand-held receiver assembly is carried by a person for receiving radio waves from the radio transmitter assembly. The components of the radio transmitter assembly are distributed along the jacket, such that the arrow, equipped with the radio transmitter assembly, is well balanced so that the arrow does not wobble in its flight path. The jacket includes a substantially smooth surface, such that the arrow has both good dynamic flight characteristics and good aerodynamic characteristics. The radio transmitter assembly includes a transmitter unit and an antenna assembly, and the antenna assembly may include antennas in the form of barbs. The jacket includes a first jacket sub-unit and a second jacket sub-unit. The first jacket sub-unit and the second jacket sub-unit are adjustable with respect to each other along the shaft of the arrow such that optimal weight distribution along the shaft of the arrow can be achieved. The hand-held receiver assembly includes a handle portion and a directional antenna portion. The hand-held receiver assembly may include an output jack for headphones. The hand-held receiver assembly may also include a compass.

4 Claims, 4 Drawing Sheets

ARROW TRACKING APPARATUS

BACKGROUND OF THE INVENTION

1. Field of the Invention

The present invention relates generally to devices for tracking wounded animals, and more particularly, to a transmitter-equipped arrow, especially adapted for using radio signals for tracking an animal wounded by an arrow.

2. Description of the Prior Art

Hunting with bow and arrow is a popular sport. When an arrow is shot from the bow, it is often difficult to locate whether it hits its target or not. If the arrow misses the target, it often disappears in the brush. If the arrow hits a target animal, such as a deer, the animal if often able to run quite a distance before it collapses as it succumbs to its wounds. In such a case, it is often difficult to locate the wounded game. In the first case, it would be desirable to locate a missing arrow. In the second case it would be desirable to locate the missing game and the missing arrow.

A number of arrows are disclosed in the prior art which are designed to locate missing arrows. For example, the following U.S. patents disclose devices designed to locate arrows that have been shot: U.S. Pat. Nos. 4,557,243; 4,749,198; 4,858,935; 4,885,800; 4,940,245; 4,976,442; and 5,024,447. More specifically, U.S. Pat. No. 4,557,243 discloses an arrow game tracker that uses a conventional arrow connected to a flexible line that is payed out as the arrow flies. This device has the advantage of using a conventional arrow, but it has a significant disadvantage with respect to the flexible line which can easily become tangled in brush. In this respect, it would be desirable if a arrow tracking device were provided which did not employ a flexible line that can readily become tangled in brush.

U.S. Pat. Nos. 4,749,198; 4,858,935; 4,885,800; 4,940,245; 4,976,442; and 5,024,447 all employ a common principle for tracking arrows. They employ radio transmitters and receivers for tracking transmitted signals. They also share another common feature. The radio transmitter is built into the shaft of the arrow. One disadvantage of a transmitter built-in to a shaft is the expense of designing and building customized arrows. In this respect, it would be desirable if an arrow tracking device were provided that did not entail the expense of designing and building customized arrows.

Another disadvantage associated with built-in transmitters is the difficulty of balancing the arrow/transmitter combination so that the flight of the arrow does not wobble and is straight and true. In this respect, it would be desirable if an arrow tracking device were provided which is well balanced with respect to the arrow so that the arrow does not wobble in its flight path.

There are very large numbers of arrows currently in use, and these arrows do not have tracking capabilities. Rather than require a bow and arrow user to discard the current arrows in use, it would be desirable if the current arrows in use could be converted or retrofitted to incorporate a radio transmitter.

For a transmitter apparatus that can be added onto a conventional arrow to retrofit the arrow with a radio transmitter, it is important that the added-on apparatus have provisions for optimum adaptation to a conventional arrow. More specifically, for an added-on transmitter, it would be desirable if the added-on transmitter had an adjustable element which facilitated optimum weight distribution.

If a transmitter assembly would be added onto a conventional arrow, it would be important for the added-on transmitter assembly to have good dynamic flight characteristics and to have good aerodynamic characteristics.

When an arrow is equipped with a radio transmitter, it is not only important that the arrow wound the animal, it is also important that the arrow remain with the animal before the animal collapses. In this respect, it would be desirable if an arrow tracking device were provided that had means for keeping the arrow on the wounded animal.

In an arrow locating system, the receiver apparatus is also of great importance. For field use, it would be desirable if the receiver apparatus would be battery-powered, light-weight, highly directional, and easily carried and used.

Hunters very often hunt in groups of two or more persons. When such is the case, another hunter could be supplied with a second receiver apparatus. The two receiver apparatuses being used together can facilitate locating the transmitting arrow. In this respect, it would be desirable if a receiver apparatus were equipped with a compass to facilitate transmitter location when more than one receiver apparatus is employed.

Thus, while the foregoing body of prior art indicates it to be well known to use arrows with radio transmitters, the prior art described above does not teach or suggest an arrow tracking apparatus which has the following combination of desirable features: (1) does not employ a flexible line that can readily become tangled in brush; (2) does not entail the expense of designing and building customized arrows; (3) has a well-balanced arrow so that the arrow does not wobble in its flight path; (4) converts or retrofits arrows which do not have a radio transmitter into ones which incorporate a radio transmitter; (5) had good dynamic flight characteristics and has good aerodynamic characteristics; (6) has means for keeping the arrow on the wounded animal; (7) provides a receiver apparatus which is battery-powered, light-weight, highly directional, and easily carried and used; (8) has an adjustable element which facilitates optimum weight distribution; and (9) includes a receiver apparatus which includes a compass to facilitate transmitter location when more than one receiver apparatus is employed. The foregoing desired characteristics are provided by the unique arrow tracking apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved arrow tracking apparatus which includes a radio transmitter assembly, attached to an arrow, for transmitting radio waves associated with the arrow. The radio transmitter assembly is in the form of a jacket that jackets a shaft of the arrow. A battery-powered hand-held receiver assembly is carried by a person for receiving radio waves from the radio transmitter assembly. The components of the radio transmitter assembly are distributed along the jacket, such that the arrow, equipped with the radio transmitter assembly, is well balanced so that the arrow does not wobble in its flight path. The jacket includes a substantially smooth surface, such that the arrow has both good dynamic flight characteristics and good aerodynamic characteristics. The radio transmitter assembly includes a transmitter unit and an antenna assembly, and the antenna assembly may include antennas in the form of barbs. The jacket includes a first jacket sub-unit and a second jacket sub-unit. The first jacket sub-unit and the second jacket sub-unit are adjustable with respect to each other along the shaft of the arrow such that optimal weight distribution along the shaft of the arrow can be achieved. The hand-held receiver assembly includes a handle portion and a directional antenna portion. The hand-held receiver assembly may include an output jack for headphones. The hand-held receiver assembly may also include a compass.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved arrow tracking apparatus which has all of the advantages of the prior art and none of the disadvantages.

It is another object of the present invention to provide a new and improved arrow tracking apparatus which may be easily and efficiently manufactured and marketed.

It is a further object of the present invention to provide a new and improved arrow tracking apparatus which is of durable and reliable construction.

An even further object of the present invention is to provide a new and improved arrow tracking apparatus which is susceptible of a low cost of manufacture with regard to both materials and labor, and which accordingly is then susceptible of low prices of sale to the consuming public, thereby making such arrow tracking apparatus available to the buying public.

Still yet a further object of the present invention is to provide a new and improved arrow tracking apparatus which does not employ a flexible line that can readily become tangled in brush.

Still another object of the present invention is to provide a new and improved arrow tracking apparatus that does not entail the expense of designing and building customized arrows.

Yet another object of the present invention is to provide a new and improved arrow tracking apparatus which is well balanced with respect to the arrow so that the arrow does not wobble in its flight path.

Even another object of the present invention is to provide a new and improved arrow tracking apparatus than can convert or retrofit conventional arrows into arrows incorporating a radio transmitter.

Still a further object of the present invention is to provide a new and improved added-on arrow tracking apparatus that has good dynamic flight characteristics and has good aerodynamic characteristics.

Yet another object of the present invention is to provide a new and improved arrow tracking apparatus that includes means for keeping the arrow on the wounded animal.

Still another object of the present invention is to provide a new and improved arrow tracking apparatus which includes a receiver apparatus that is battery-powered, light-weight, highly directional, and easily carried and used.

Yet another object of the present invention is to provide a new and improved arrow tracking apparatus with an added-on transmitter that has an adjustable element which facilitates optimum weight distribution of the transmitter apparatus on the arrow.

Still a further object of the present invention is to provide a new and improved arrow tracking apparatus that has a receiver apparatus equipped with a compass to facilitate transmitter location when more than one receiver apparatus is employed.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved arrow tracking apparatus embodying the principles and concepts of the present invention will be described.

Figure 1:
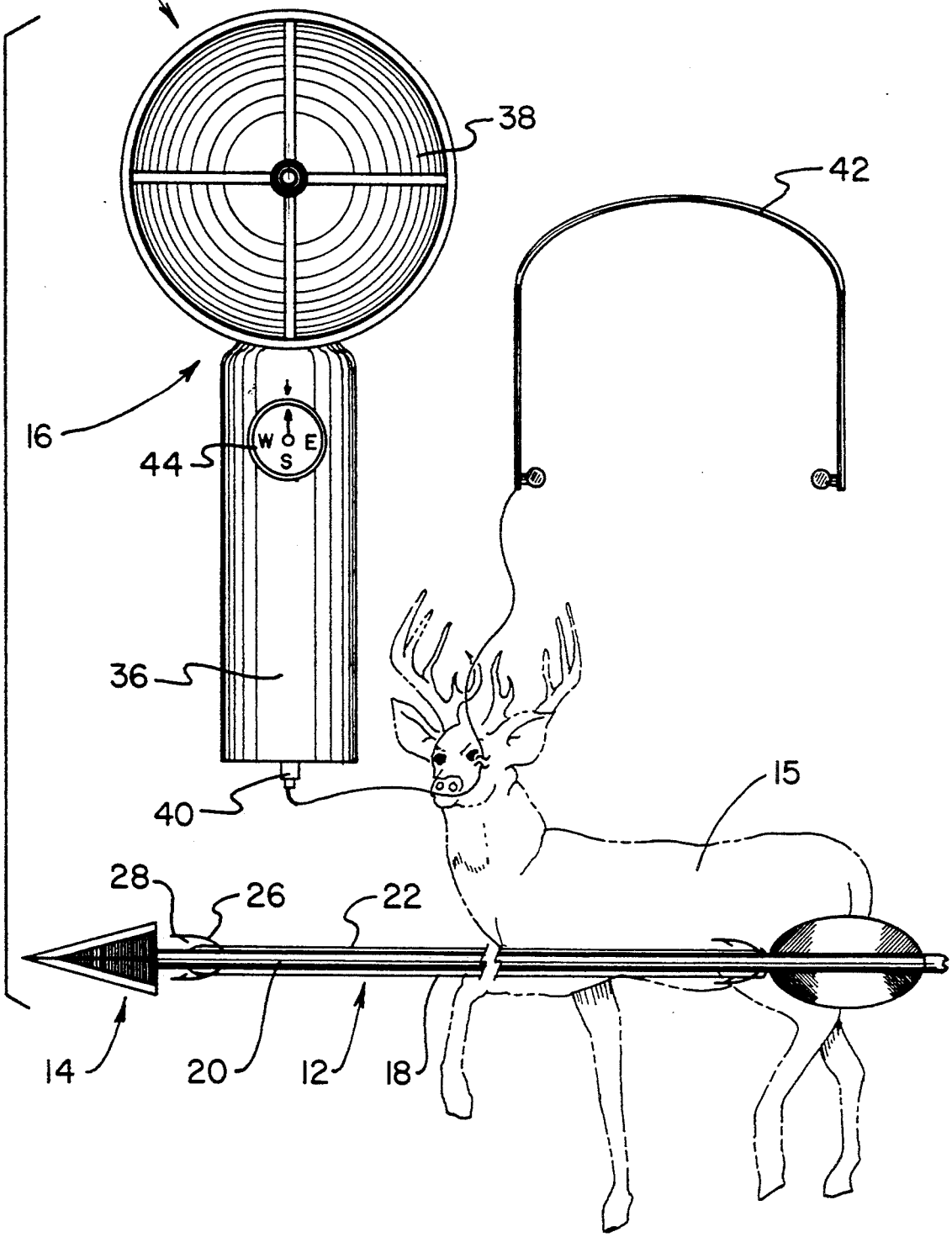
FIG. 1 is a perspective view showing a first preferred embodiment of the arrow tracking apparatus of the invention in which the transmitter assembly is in the form of a jacket for the shaft of a conventional arrow.
Figure 2:
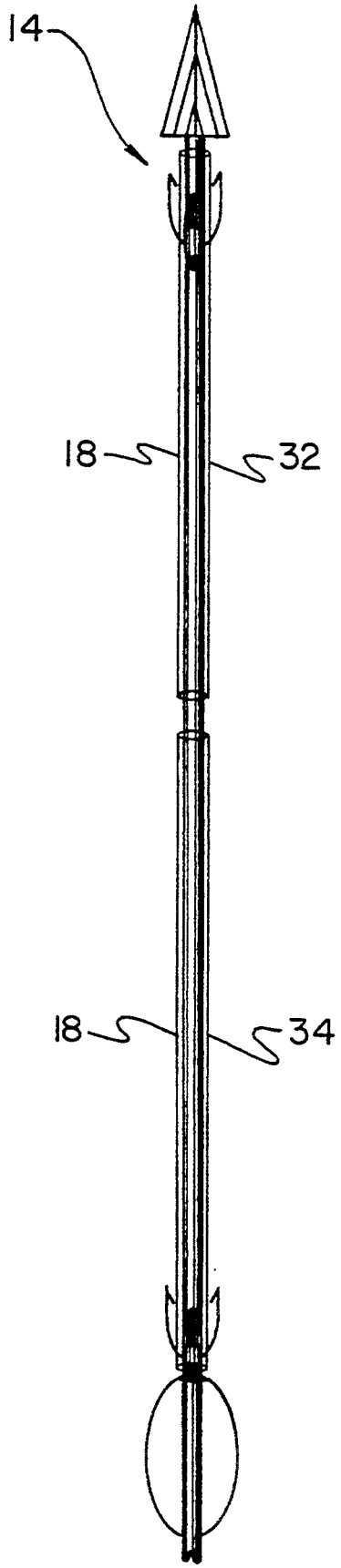
FIG. 2 is an enlarged side view of the arrow shown in FIG. 1.

Turning initially to FIGS. 1–2, there is shown a first exemplary embodiment of the arrow tracking apparatus of the invention generally designated by reference numeral 10. The apparatus may be used in hunting game such as deer 15. The arrow tracking apparatus 10 includes a battery-powered radio transmitter assembly 12, attached to an arrow 14, for transmitting radio waves associated with the arrow 14. Battery 13 powers the radio transmitter assembly 12 (see FIG. 6). The radio transmitter assembly 12 is in the form of a jacket 18 that jackets a shaft 20 of the arrow 14. A battery-powered hand-held receiver assembly 16, carried by a person, receives radio waves from the radio transmitter assembly 12.

The components of the radio transmitter assembly 12 are distributed along the jacket 18, such that the arrow 14, equipped with the radio transmitter assembly 12, is well balanced so that the arrow 14 does not wobble in its flight path. In addition, the jacket 18 includes a substantially smooth surface 22, such that the arrow 14 has good dynamic flight characteristics and has good aerodynamic characteristics.

As shown in FIG. 1, a substantial portion of a shaft of the arrow is located between a front portion of the arrow and a rear portion of the arrow, such that the arrow, equipped with said radio transmitter assembly means, is well balanced so that the arrow does not wobble in its flight path. Also, as shown in FIG. 1, the jacket has a diameter substantially less than a diameter of an arrow head, and the jacket includes a substantially smooth surface, such that the arrow has good dynamic flight characteristics and has good aerodynamic characteristics.

Barbs may be present on the arrow 14 to assure fixing of the arrow 14 to a target animal. The barbs may be present on the arrow shaft 20 or on the jacket 18 of the arrow tracking apparatus of the invention.

Figure 6:
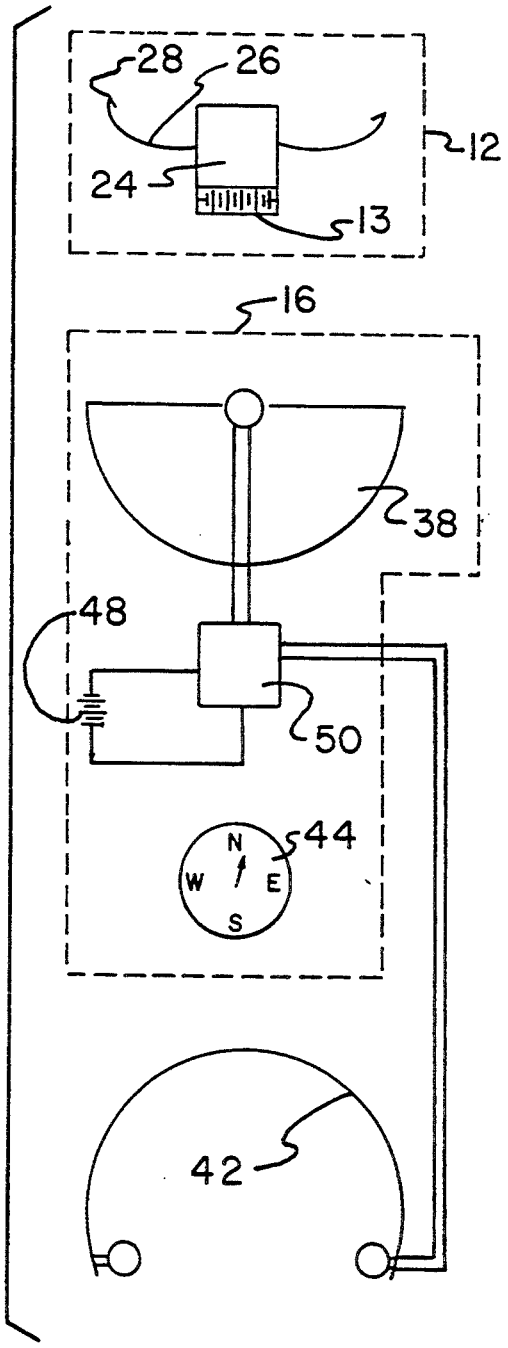
FIG. 6 is a schematic diagram of the transmitter apparatus and the receiver apparatus of the invention.

The radio transmitter assembly 12 includes a transmitter unit 24 and an antenna assembly 26 (see FIG. 6). The antenna assembly 26 may include antennas in the form of barbs 28.

As shown in FIG. 2, the jacket 18 includes a first jacket sub-unit 32 and a second jacket sub-unit 34. The first jacket sub-unit 32 and the second jacket sub-unit 34 are adjustable with respect to each other along the shaft 20 of the arrow 14. By proper adjustment of the respective first jacket sub-unit 32 and the second jacket sub-unit 34 along the shaft 20, the combination of the arrow 14 and the arrow tracking apparatus of the invention can be optimally balanced to assure stable flight of the arrow 14.

The hand-held receiver assembly 16 includes a handle portion 36 and a directional antenna portion 38. The hand-held receiver assembly 16 includes an output jack 40 for headphones 42. The hand-held receiver assembly 16 also includes a compass 44. When more than one hand-held receiver assembly 16 is used to locate an arrow 14, the presence of respective compasses 44 on the respective hand-held receiver assemblies 16 helps to facilitate transmitter location.

Figure 3:
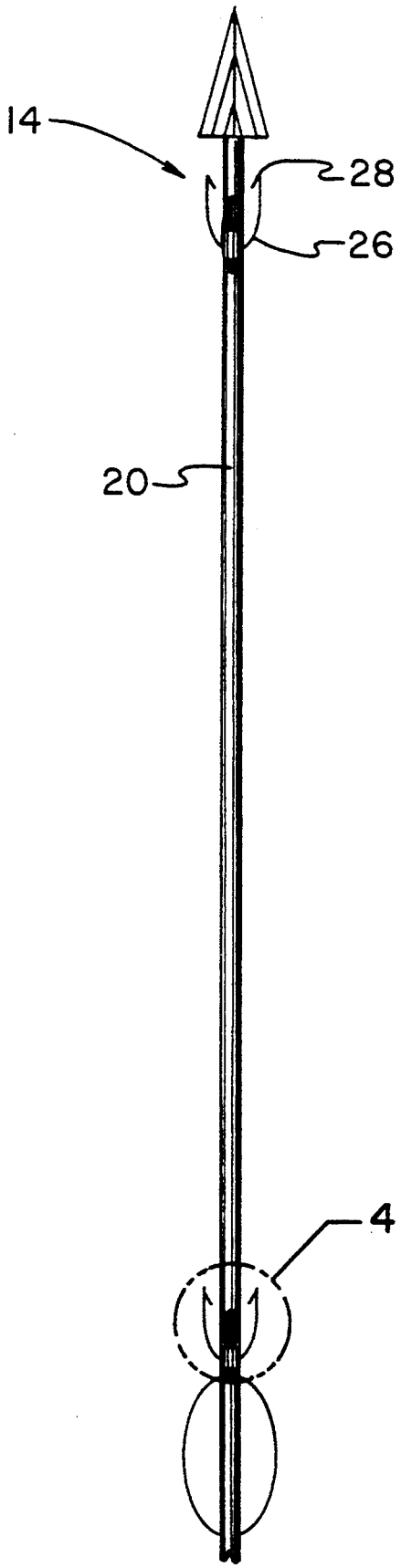
FIG. 3 is a side view of a second embodiment of a radio-transmitting arrow of the invention wherein the transmitter is housed in the body of the arrow shaft, and antennas for the transmitter are in the form of barbs.
Figure 4:
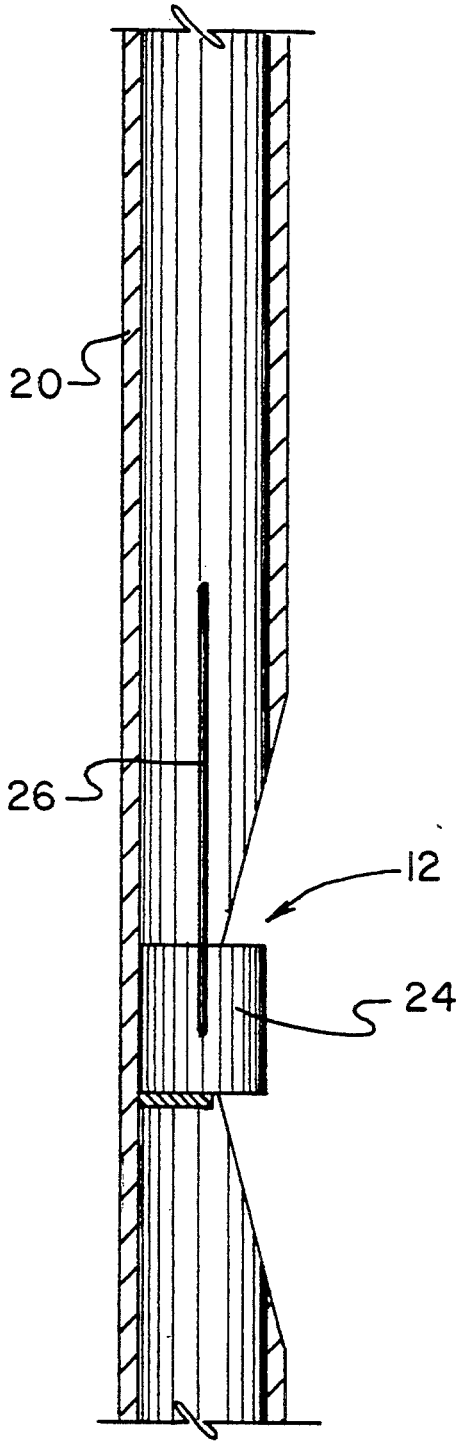
FIG. 4 is an enlargement of the portion of FIG. 3 encircled by circle 4 showing a transmitter antenna in the form of barbs.

Turning to FIGS. 3–4, a second embodiment of the invention is shown. Reference numerals are shown that correspond to like reference numerals that designate like elements shown in the other figures. In addition, a radio transmitter assembly 12 includes a transmitter unit 24 placed within a shaft 20 of an arrow 14. The antenna assembly 26 is in the form of barbs 28.

Figure 5:
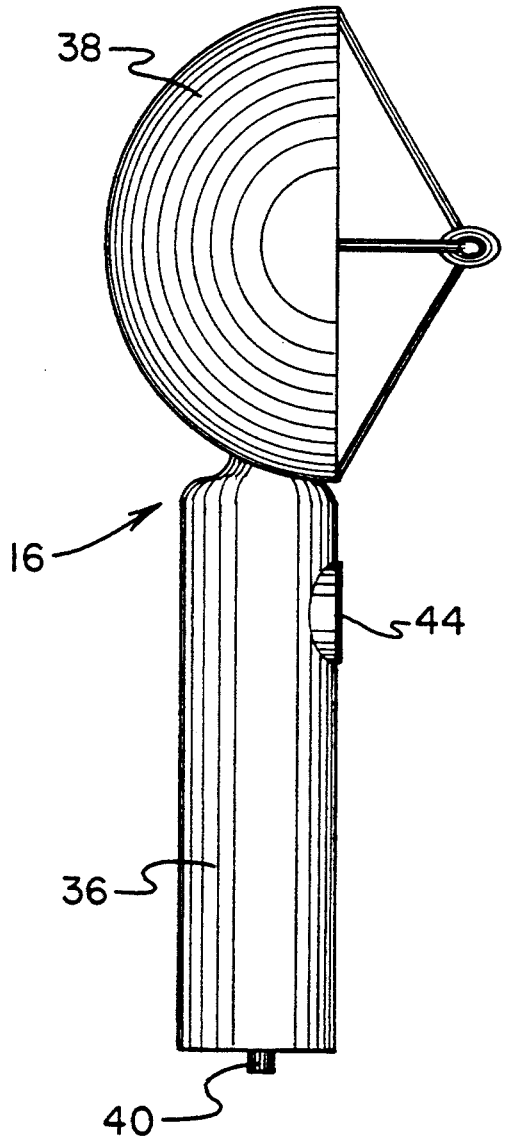
FIG. 5 is a side view of a receiver apparatus of the invention.

Turning to FIG. 5, an enlarged side view of a hand-held receiver assembly 16 is shown. Reference numerals are shown that correspond to like reference numerals that designate like elements shown in the other figures.

Turning to FIG. 6, a schematic diagram of the radio transmitter assembly 12 and the hand-held receiver assembly 16 of the invention are shown. Reference numerals are shown that correspond to like reference numerals that designate like elements shown in the other figures. In addition, a battery 48 is provided for powering the hand-held receiver assembly 16. A signal processing unit 50 is provided for processing signals picked up by the directional antenna portion 38 and sent to the output jack 40 for the headphones 42.

The components of the arrow tracking apparatus of the invention can be made from inexpensive and durable metal or plastic materials. The electronic circuitry used is conventional, inexpensive, and readily available.

It is apparent from the above that the present invention accomplishes all of the objects set forth by providing a new and improved arrow tracking apparatus that is low in cost, relatively simple in design and operation, and which may advantageously be used to convert a conventional arrow into an arrow that has a radio transmitter. Also, with the invention, an arrow tracking apparatus is provided which does not employ a flexible line that can readily become tangled in brush. With the invention, the expense of designing and building customized arrows is avoided. With the invention, a radio transmitting arrow is provided which is well balanced so that the arrow does not wobble in its flight path. With the invention, the added-on transmitter assembly provides an arrow that has good dynamic flight characteristics and that has good aerodynamic characteristics. With the invention, barbs are provided for keeping the arrow on the wounded animal. With the invention, the receiver apparatus is battery-powered, light-weight, highly directional, and easily carried and used. With the invention, the added-on transmitter has an adjustable element which facilitates optimum weight distribution on the arrow. With the invention, a receiver apparatus is equipped with a compass to facilitate transmitter location when more than one receiver apparatus is employed.

With respect to the above description, it should be realized that the optimum dimensional relationships for the parts of the invention, to include variations in size, from function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. An arrow tracking apparatus, comprising:

radio transmitter assembly means, attached to an arrow, for transmitting radio waves associated with the arrow, said radio transmitter assembly means being in the form of a jacket that jackets a substantial portion of a shaft of the arrow between a front portion of the arrow and a rear portion of the arrow, such that the arrow, equipped with said radio transmitter assembly means, is well balanced so that the arrow has stable flight in its flight path, wherein said jacket has a diameter substantially less than a diameter of an arrow head, and wherein said jacket includes a substantially smooth surface, such that the arrow has good aerodynamic characteristics, and battery-powered hand-held receiver assembly means, carried by a person, for receiving radio waves from said radio transmitter assembly means.

2. The apparatus described in claim 1 wherein:

said radio transmitter assembly means include a transmitter unit and an antenna assembly, and said antenna assembly includes antennas in the form of barbs.

3. An arrow tracking apparatus, comprising:

radio transmitter assembly means, attached to an arrow, for transmitting radio waves associated with the arrow, said radio transmitter assembly means being in the form of a jacket that jackets a substantial portion of a shaft of the arrow between a front portion of the arrow and a rear portion of the arrow, such that the arrow, equipped with said radio transmitter assembly means, is well balanced so that the arrow has stable flight in its flight path, wherein said jacket includes a first jacket sub-unit and a second jacket sub-unit wherein said first jacket sub-unit and said second jacket sub-unit are adjustable with respect to each other along the shaft of the arrow, wherein said jacket has a diameter substantially less than a diameter of an arrow head, and wherein said jacket includes a substantially smooth surface, such that the arrow has good aerodynamic characteristics, and battery-powered hand-held receiver assembly means, carried by a person, for receiving radio waves from said radio transmitter assembly means, wherein said hand-held receiver assembly means includes a handle portion and a directional antenna portion, wherein said hand-held receiver assembly means includes an output jack for headphones.

4. An arrow tracking apparatus, comprising:

radio transmitter assembly means, attached to an arrow, for transmitting radio waves associated with the arrow, said radio transmitter assembly means being in the form of a jacket that jackets a substantial portion of a shaft of the arrow between a front portion of the arrow and a rear portion of the arrow, such that the arrow, equipped with said radio transmitter assembly means, is well balanced so that the arrow is stable in its flight path, wherein said jacket has a diameter substantially less than a diameter of an arrow head, and wherein said jacket includes a substantially smooth surface, such that the arrow has good aerodynamic characteristics, wherein said jacket includes a first jacket sub-unit and a second jacket sub-unit wherein said first jacket sub-unit and said second jacket sub-unit are adjustable with respect to each other along the shaft of the arrow, and battery-powered hand-held receiver assembly means, carried by a person, for receiving radio waves from said radio transmitter assembly means, wherein said hand-held receiver assembly means include a handles portion and a directional antenna portion, wherein said hand-held receiver assembly means includes an output jack for headphones, and wherein said hand-held receiver assembly means includes a compass.

* * * * *